US005531604A

United States Patent [19]

Huang

[11] Patent Number: 5,531,604

[45] Date of Patent: Jul. 2, 1996

[54] ELECTRIC CONNECTOR

[76] Inventor: Huang C. Huang, 5th Fl., No. 59-1, section 1, Jiow Juang Street, Nang Kang, Taipei, Taiwan

[21] Appl. No.: 274,177

[22] Filed: Jul. 12, 1994

[51] Int. Cl.[6] ..... H01K 9/09

[52] U.S. Cl. ..... 439/79; 439/752

[58] Field of Search ..... 439/79, 80, 752

[56] References Cited

U.S. PATENT DOCUMENTS 5,249,974 10/1993 Wang ..... 439/79
5,340,320 8/1994 Puerner ..... 439/79
5,346,404 9/1994 Shimada ..... 439/79
5,354,207 10/1994 Chikano ..... 439/79

*Primary Examiner*—P. Austin Bradley
*Assistant Examiner*—Jill DeMello
*Attorney, Agent, or Firm*—Pro-Techtor International

[57] ABSTRACT

An electric connector including a base block with two opposite slideways that receive tongues on a flexible cover plate. The connector further includes a plurality of terminals each of which is inserted into grooves in said base block. Upper connecting ends of the terminals form two parallel rows. The cover plate protects the terminals form being dislodged when a male connector or IC card is plugged into the connector. The cover plate also prevents dirt and water vapor from adhering to the terminals to negatively affect the performance of the electric connector.

1 Claim, 3 Drawing Sheets

ELECTRIC CONNECTOR

BACKGROUND OF THE INVENTION

The present invention relates to an electric connector which is slim in size, and has a cover plate to protect the terminals from being pushed out and also prevent any dirt or water vapor from adhering to the terminals to negatively affect the performance of the electric connector.

As computers have been widely used nowadays, there is an ever increasing demand for electric connectors to connect computers with their peripherals, and to cope with the trend of going slim, efforts have been made to downsize conventional electric connectors, but no satisfactory result has been obtained.

FIG. 1 illustrates a D-Sub electric connector 1 according to the prior art, having a plurality of terminals 11 engaged into respective holes 12 on a base block 10 for positioning. However, as the surface of the base block 10 and the inner surface of the holes are smooth, they have no way to give a tight fit for the terminals 11. Therefore, it causes a clearance between the holes 12 and the terminals 11, making the terminals 11 inevitably swayed in the holes and difficult in aligning with each other, so as to result in a poor connection effect with a male connector, thereby causing a magnetic interference between the terminals 11. Also, the terminals 11 tend to get damaged or deformed in case of a force fit, and are often pushed out upon plugging a male connector. Further, the terminals 11 are easily exposed to dirt and moisture, thus negatively affecting the performance of the electric connector. Moreover, conventional electric connectors are usually constructed in such a manner that has an overall thickness of the terminals 11 and the base block 10 after assembly, which occupies more space and does not meet the requirement to go slim, especially at the time when portable or laptop computers are developed to attain the purpose of getting downsize.

SUMMARY DESCRIPTION OF THE INVENTION

The present invention has been accomplished to eliminate the aforesaid problems. It is therefore the primary object of the present invention to provide an electric connector which comprises a cover plate to protect the terminals from being pushed out upon plugging a male connector, and also to keep them free from any magnetic interference, dirt or moisture.

It is another object of the present invention to provide an electric connector which comprises a plurality of grooves for flushing by the terminals, thus enabling to have the terminals aligned with each other and downsize the electric connector.

DETAILED DESCRIPTION OF THE PREFERRED EMBODIMENT

Figure 1:
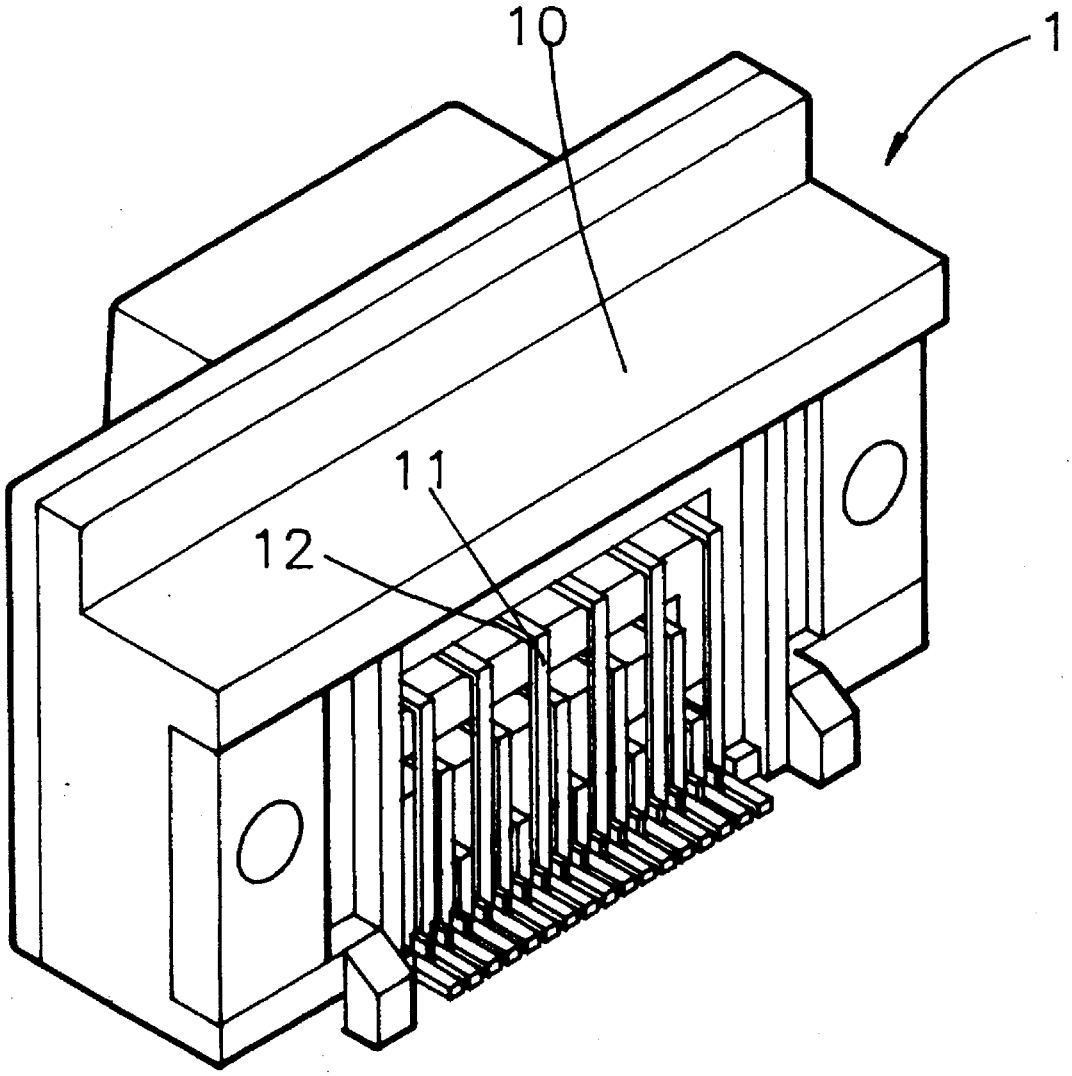
FIG. 1 PRIOR ART
FIG. 1 is an elevational view of an electric connector according to the prior art.
Figure 2:
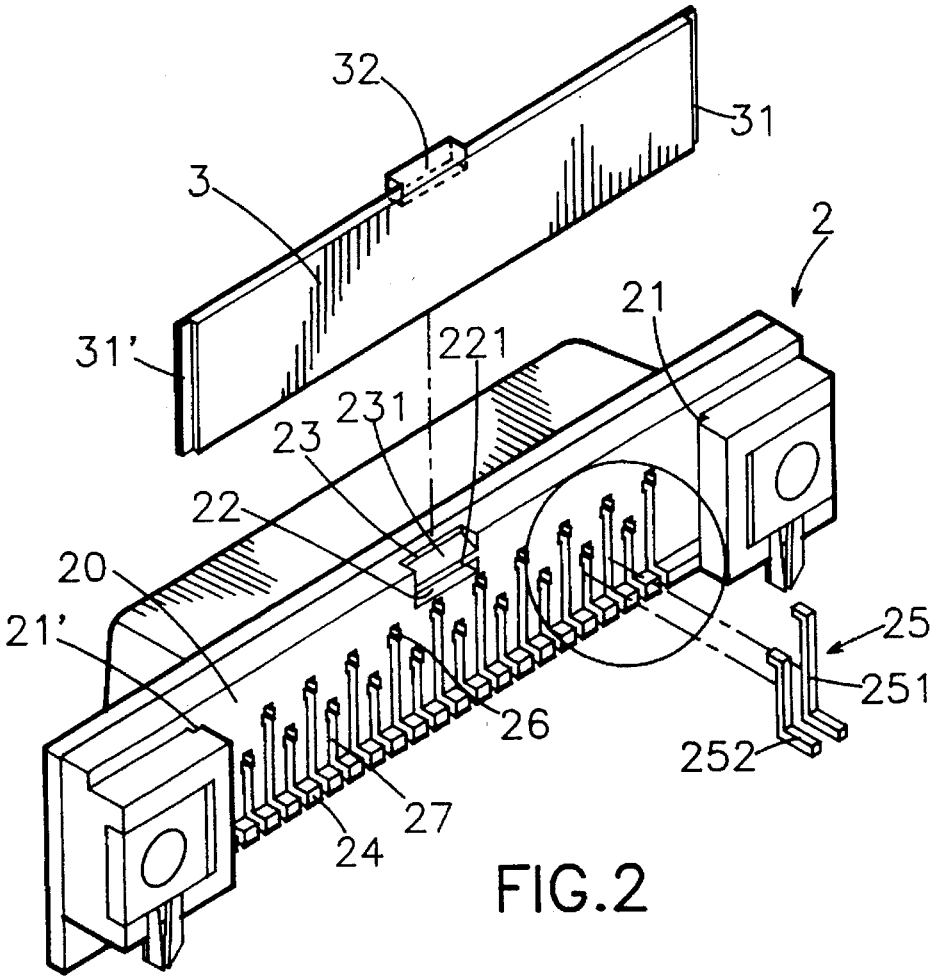
FIG. 2 is an exploded perspective view of an electric connector according to the present invention.
Figure 2A:
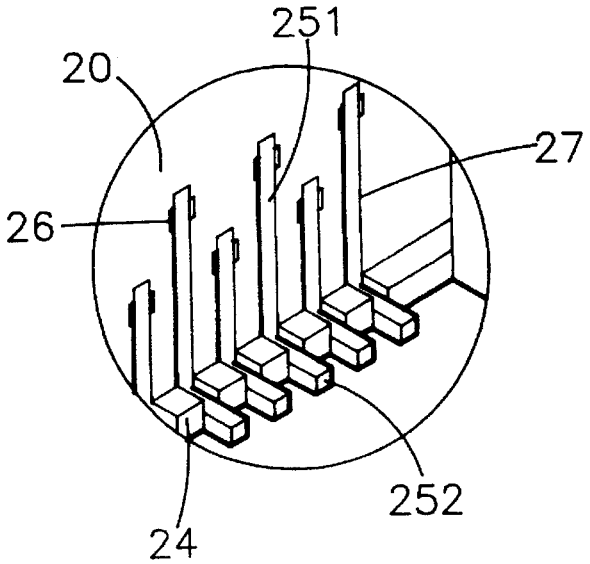
FIG. 2*a* is a partial enlarged view, showing how the terminals are engaged into respective grooves according to the present invention.

Referring to FIG. 2, an electric connector 2 in accordance with the present invention is generally comprised of a base block 20 and a rectangular cover plate 3 made from a flexible material.

The base block 20 comprises two opposite slideways 21, 21' disposed on both sides thereof, a center hole 22 cut at a place near the front top and spaced at an adequate interval 221 from a center opening 23 disposed at the top and having an inwardly inclined plane 231, a plurality of projections 24 perpendicularly extended from the front bottom and spaced from each other at equal interval, a plurality of parallel grooves 27 spaced from each other at equal interval and respectively extended from between two adjacent projections 24 to a plurality of thru-holes 26 arranged in two rows. There are a plurality of terminals each of which is bent at 90 degrees twice to form an upper and a lower connecting ends perpendicular to a central portion 251, with the upper connecting end inserted into one of the thru-holes 26. The rectangular cover plate 3 comprises two tongues 31, 31' extended outwards from both sides thereof at the rear, and a center catch means 32 at the rear top.

Figure 3:
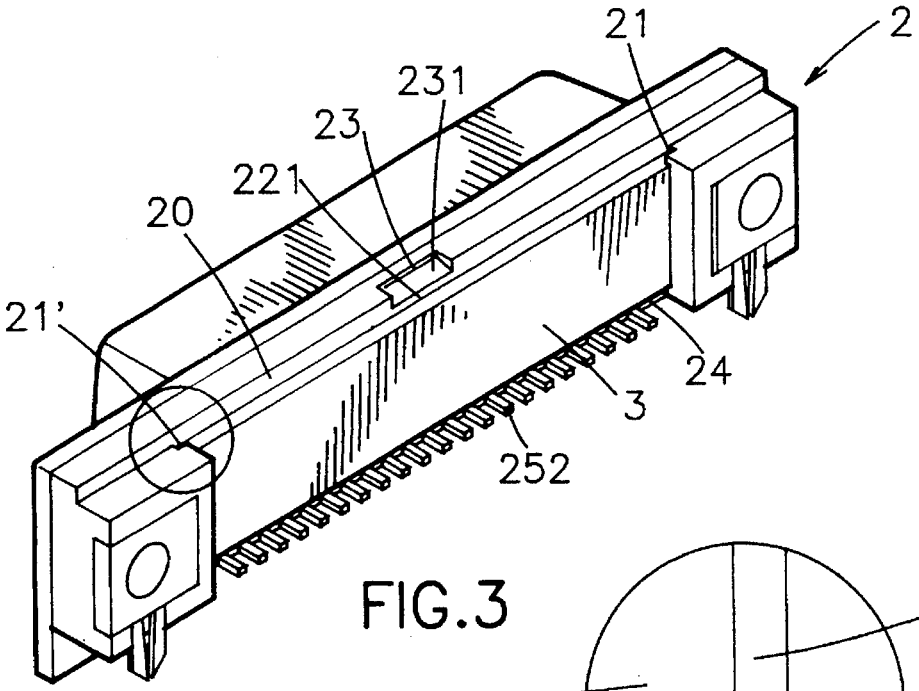
FIG. 3 is an applied view of the electric connector as shown in FIG. 2.
Figure 3A:
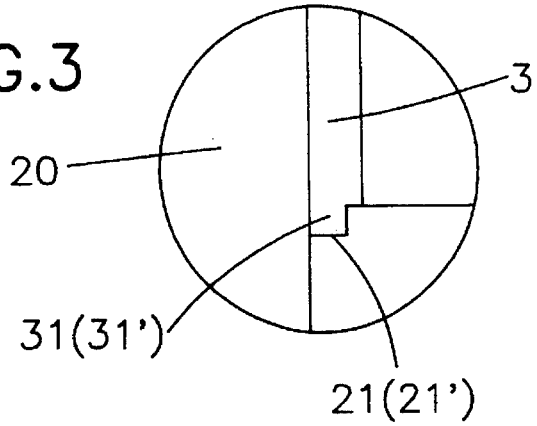
FIG. 3*a* is a partial enlarged view, showing how a cover plate is mounted on a base block according to to the present invention.
Figure 4:
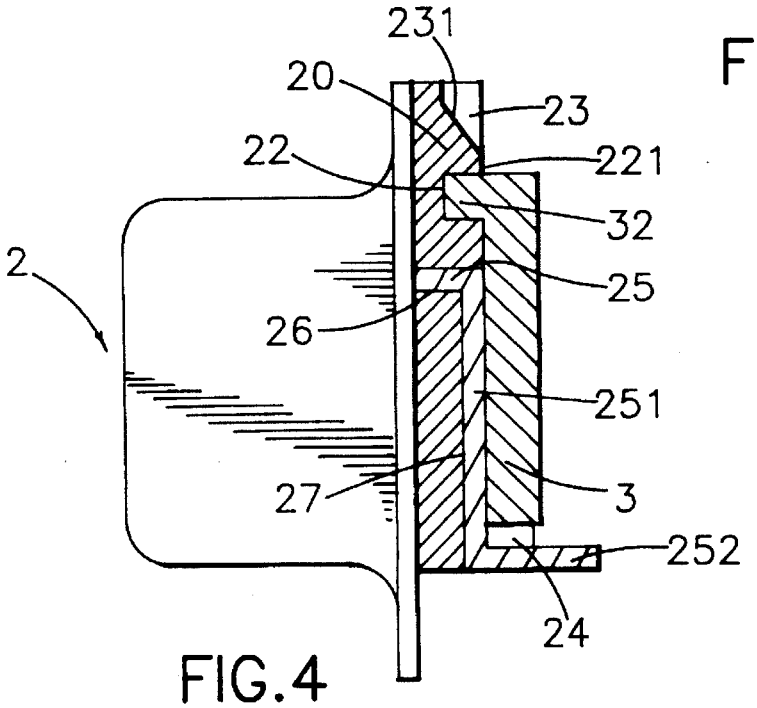
FIG. 4 is an assembled sectional view of the electric connector according to the present invention.

Referring to FIGS. 3 and 4, when one of the terminals 25 is inserted into its respective thru-hole 26 via its upper connecting end, and its central portion 251 is tightly fitted into its respective groove 27 underneath this thru-hole 26, its lower connecting end 252 can protrude from between two projections 24 on either side of this groove 27. After all the terminals 25 are set in such a manner, slip the cover plate 3 into the two slideways 21, 21' until it rests on the plurality of projections 24, with which the center catch means 32 of the cover plate 3 can easily go down along the inclined plane 231 of the center opening 23 to engage with the center hole 22 for positioning, and the two tongues 31, 31' can be firmly held by the two slideways 21, so that the cover plate 3 will not be slipped off.

Also, the terminals 25 firmly insert their bodies 251 and lower connecting ends 252 in the grooves 27, thus preventing any "sway caused by the clearance between the terminals 25 and the thru-holes 26, and eliminating any "magnetic interference" occurred between the terminals 25. In the meantime, the terminals 25 flush the grooves 27 with their bodies 251, thus enabling to downsize the electric connector 2. Further, when the cover plate 3 covers the base block 20, it can protect the terminals 25 from being pushed out upon plugging a male connector or an IC card, and can also prevent any dirt or water vapor from adhering to the terminals 25 to negatively affect the performance of the electric connector 2.

What is claimed is:

1. An electric connector comprising:

a base block, said base block comprising two opposite slideways on each of two sides thereof, a center hole near a front top portion and spaced from a center opening on a top surface thereof, and said base block having an inwardly inclined plane, a plurality of projections perpendicularly extended from a front bottom portion, a plurality of parallel grooves spaced from each other at equal intervals and respectively extended from between two adjacent projections to a plurality of through holes arranged in two rows;

a plurality of terminals each of which is bent at 90 degrees twice to form an upper and a lower connecting end perpendicular to a central portion, with said upper connecting end inserted into one of said through holes, said central portion is tightly fitted into one of said grooves, and said lower connecting end protrudes from between said two projections on either side of the same groove; and a rectangular cover plate made from a flexible material, comprising two tongues extended outward from a first and a second end thereof, said tongues are received in said two slideways, and a center catch means at a rear top portion to engage with said center hole for positioning.

* * * * *